US005271191A

United States Patent [19]

Vahamaki

[11] Patent Number: 5,271,191

[45] Date of Patent: Dec. 21, 1993

[54] GUTTER SHIELD AND SUPPORT

[75] Inventor: Henry J. Vahamaki, Scarborough, Canada

[73] Assignee: Trim Tool & Die Company, Inc., Ontario, Canada

[21] Appl. No.: 854,829

[22] Filed: Mar. 20, 1992

[51] Int. Cl.[5] ..... E04D 13/04

[52] U.S. Cl. ..... 52/12; 210/474

[58] Field of Search ..... 52/12; 210/474, 475

[56] References Cited

U.S. PATENT DOCUMENTS 2,271,081 1/1942 Layton ..... 52/12
2,583,422 1/1952 Haddon ..... 52/12
4,418,504 12/1983 Lassiter ..... 52/12
4,727,689 3/1988 Bosler ..... 52/12
4,866,890 9/1989 Otto ..... 52/12
4,876,827 10/1989 Williams ..... 52/12
5,010,696 4/1991 Knittel ..... 52/12

*Primary Examiner*—Henry E. Raduazo
*Assistant Examiner*—Christopher T. Kent
*Attorney, Agent, or Firm*—Watson, Cole, Grindle & Watson

[57] ABSTRACT

An elongated gutter shield has marginal areas and an intermediate slotted vanes. The gutter shield allows rain water to enter the gutter through the vanes and also acts as a support joining the outboard edge of the gutter to the roof.

8 Claims, 2 Drawing Sheets

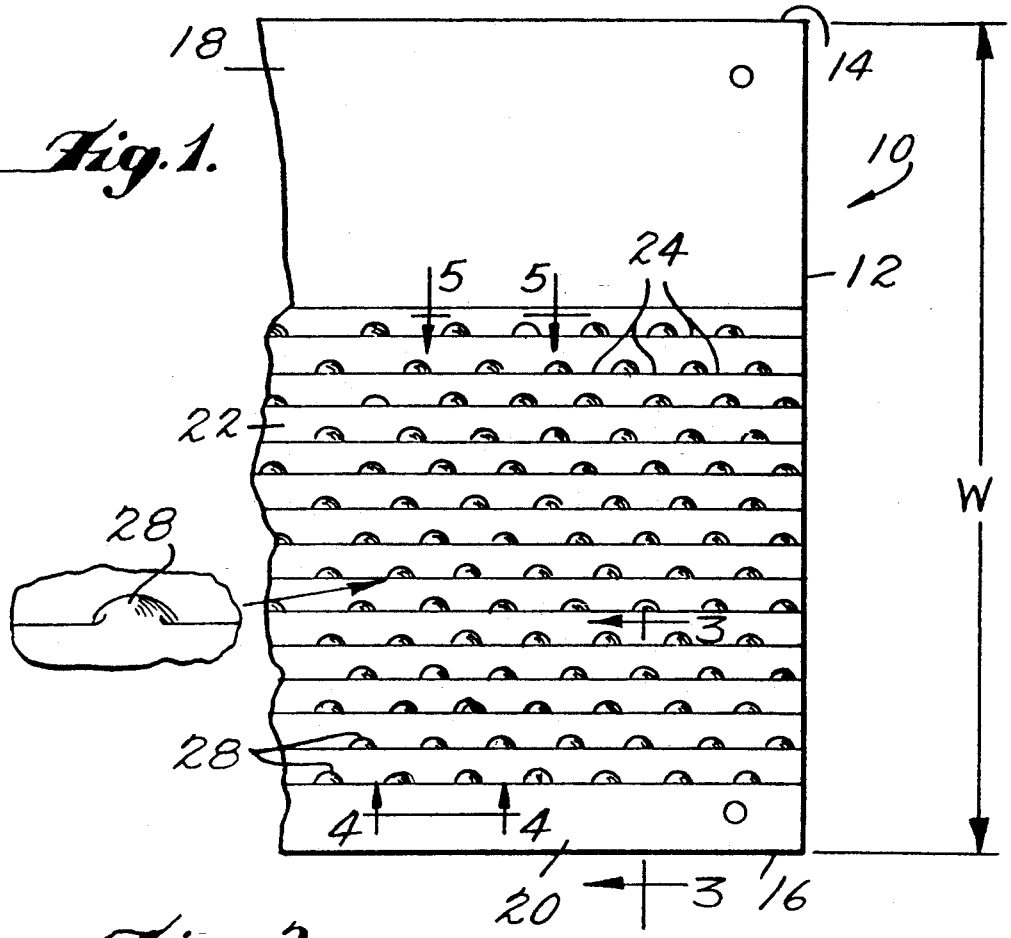
Fig. 1.
Fig. 3
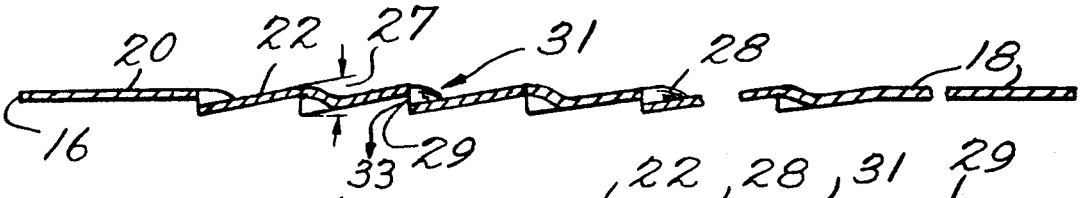
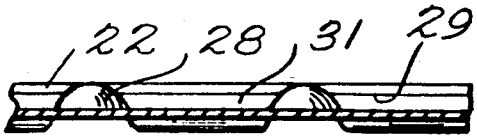
Fig. 5.
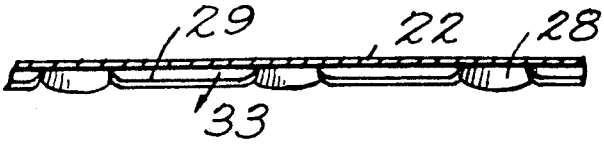
Fig. 4.

GUTTER SHIELD AND SUPPORT

BACKGROUND OF THE INVENTION

This invention relates to gutter shields and, in particular, relates to a gutter shield adapted to prevent the accumulation of debris (e.g. seeds, twigs and leaves) in the gutter and to impart a support to the gutter structure as well as provide a shield for the roof edge.

It is well known that open trough house gutters fill with leaves and other debris causing impaired effectiveness of the gutter as a roof drainage system. Frequently, water accumulates in clogged gutters causing an overflow failure which can damage the building. If the gutters freeze, the expanding water can deform the gutter and may cause it to pull away from the building support. The water may also force its way under the shingles or roof covering causing damage to the roof itself Some known gutter shields are formed of a so-called expanded metal or screen material in which a web of metal stock is slotted and then drawn or expanded so as to stretch the slots to form openings for water and yet at the same time shield the gutter from debris. Such systems, while somewhat effective in guarding against accumulation of larger debris (e.g. twigs and leaves) in the gutters have openings which are large enough to allow through small pieces of debris (e.g. small seeds and leaf fragments). If not removed, these materials accumulate and eventually clog the gutter.

Prior art systems can become externally clogged because such arrangements have a rather rough surface texture which allows debris to accumulate on the shield itself thereby blocking the gutter and rendering it ineffective. In such cases, water can well up about the accumulated debris and migrate under the edge of the roof causing damage.

Known screen arrangements are usually secured horizontally across the opening of the gutter. The weight of accumulated debris on the gutter, which bears the weight of the shield as well as the debris accumulated thereon, can cause the gutter or the screen to collapse. Thus, the screen may create more problems than it solves. There is therefore a need for a gutter shield which is effective to prevent the accumulation of debris in a gutter and which allows the debris to fall away or be swept from the shield and at the same time to support the gutter and protect the roof against damage.

SUMMARY OF THE INVENTION

The present invention comprises a gutter shield adapted to be secured to an outboard edge the open top of a gutter adjacent the roof edge of a structure for allowing rain water to enter the gutter through the open top and for restricting the accumulation of debris in the gutter and on the shield. In a particular embodiment, the gutter shield comprises an elongated member formed with top and bottom surfaces having inboard and outboard marginal areas and corresponding inboard and outboard marginal edges. An intermediate slotted vane portion is located between the inboard and outboard marginal areas. The slotted vane portion is formed with a plurality of slots arranged in a plurality of rows running parallel to the marginal edges. The vane portion includes a plurality of vanes running parallel to the marginal edges, one each adjacent a corresponding one of the rows of slots. The vanes extend from the slotted vane portion away from the bottom side of the member for directing rain water into the gutter. A plurality of vane supports interconnect adjacent vanes between the slots and are shaped so as to further direct rain water into the slots, the vanes and vane supports have upper surface portions which do not extend above the plane of the upper side of the member. The rectangular member has a width which is sufficient to allow the inboard marginal area to overly the roof edge for attachment thereto and to allow the outboard marginal area to overly the outboard gutter edge for attachment thereto. In a preferred embodiment, the gutter shield lies at an angle generally corresponding to the pitch of the roof, and the vane portion overlays the open top of the gutter when the shield is attached between the roof and the outboard gutter edge.

BRIEF DESCRIPTION OF THE DRAWINGS

FIG. 1 is a fragmentary plan view of a length of gutter guard in accordance with the present invention with an enlarged detail of a vane support;

FIG. 3 is a sectional view of the gutter guard of the present invention along line 3—3 of FIG. 1;

FIG. 4 is a fragmentary sectional view of a vane inlet taken along line 4—4 of FIG. 1; and FIG. 5 is a fragmentary sectional view of a vane outlet taken along line 5—5 of FIG. 1.

DESCRIPTION OF THE INVENTION

Figure 2:
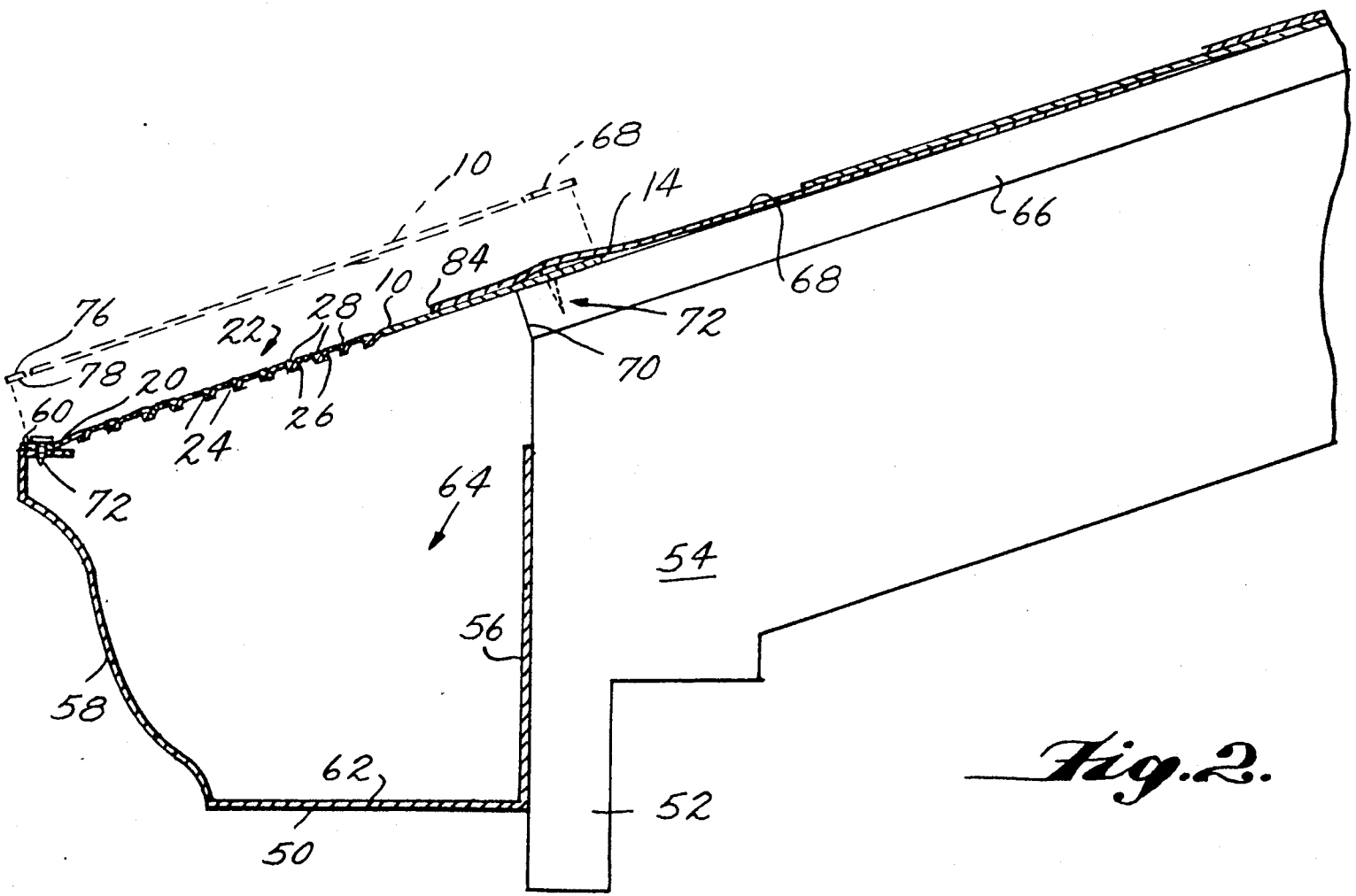
FIG. 2 is a side sectional elevation of the gutter guard illustrated in FIG. 1 installed over a gutter at the edge of a roof structure.

Referring to FIGS. 1-3, in accordance with the present invention, there is provided a gutter guard or shield 10 formed of a length of planar stock material 12 having respective parallel inboard and outboard marginal edges 14 and 16 separated by a distance W representing the width of the planar stock material 12. The gutter shield 10 further comprises a first relatively wide inboard area 18 and a second relatively narrow outboard area 20. An intermediate vane portion 22 is disposed between the respective inboard and outboard marginal areas 18 and 20. The vane portion 22 is formed with a plurality of intermittent open slots 24 arranged in parallel rows. The slots 24 define parallel vanes 26 which are formed between the slots 24. The stock material is formed so that the vanes 26 lie at an angle 27 relative to the plane of the stock material. The deformation widens slots 24 forming a gap 29 therein having an inlet 31 and an outlet 33. The vane angle 27 directs rain water into the slot and the gap 29 is sufficiently wide (e.g. 0.05") to allow rain water therethrough, but small enough to block seeds and small debris fragments from passing through. Vane supports 28 located alternately between adjacent slots support the vanes 26.

FIG. 2 illustrates the gutter shield 10 installed over gutter 50 which is secured to the facia board 52 of a pitched roof structure 54. It should be understood that the invention may be employed with a variety of roof structures. The pitched roof structure 54 illustrated is simply a convenient expedient for describing the invention and is a preferred application.

The gutter 50 is typically formed from a sheet of stock material having an upstanding inboard wall 56 which abuts the facia 52 and an outboard upstanding wall 58 having a formed upper marginal edge which turns inwardly of the gutter 50. A bottom wall portion 62 interconnects the respective inboard and outboard upstanding walls 56 and 58 and forms an open trough portion 64. The gutter 50 may be secured to the facia boards 52 by any conventional means including brackets or long ferrule nails, not shown.

In the arrangement illustrated in FIG. 2, the roof 54 has a sheathing portion 66 which extends to the roof edge 67. The sheathing 66 is covered with overlying shingles 68. The roof edge 67 generally extends up to the facia board, as illustrated. The gutter guard 10 is shown installed over the gutter 50. The inboard marginal area 18 is secured to the upper surface 69 of the sheathing 66 along the roof edge 67 and the outboard marginal area 20 is shown secured to the upper marginal edge 60 of the gutter 50. In a preferred embodiment, the gutter guard 10 lies along and is generally aligned with the pitch of the roof structure 54, and the shingles 68 are disposed over the gutter shield at the inboard marginal edge 18. The vane portion 22 is located above the open trough 64 of the gutter 50 for directing rainwater and the like therein.

In FIG. 2, the gutter shield 10 and the roof shingles 68 are shown in a phantom view representing the typical preinstalled configuration. The attachment of the gutter shield 10 to the roof 54 and the marginal edge of the gutter 50 may be accomplished by means of self tapping screws 72 as shown. Other appropriate fastening means may be employed.

In the side sectional view of FIG. 2 it can be seen that gutter shield 10 has respective upper and lower surfaces 76 and 78 and the vane portions 26 extend away from the lower surface 78 as illustrated. It can also be seen that the vane supports 28 generally do not extend above the upper surface 76. Thus, any accumulated debris on the upper surface tends to be washed away by rainwater and the like which may run off the roof 66. At the same time, it can be seen that the vane portions 26 are formed such that the slots 24 are sufficiently wide so that rainwater can run down and along the shield 10 and enter the open trough 64 as directed the vanes 26 as illustrated.

FIG. 3 illustrates in sectional view a portion of the vane supports 28 which are dome like formations in the stock material 12. The vane supports 28 merge with the vanes 26 and have lower edges 80 directed downwardly into the slots 24 to promote deflection of the rainwater into the slots and the gutter 50.

The inboard lateral area 18 of the shield 10 protects the roof sheathing 66 near the roof edge 90 and acts like a starting course for the shingles 68. It can be seen that the inboard lateral area 18 covers the roof and protects it from water seepage. Also, the lie of the gutter shield 10 along the pitch of the roof 66 helps to deflect that water away from the roof such that instead of dripping off the outermost edge 84 of the shingles 68 that water may travel along the gutter shield and into the slots 24.

The gutter shield 10 acts to support the gutter 10 in a way not previously available in prior systems. In the arrangement illustrated, the gutter shield 10 is secured to the roof sheathing 66 along the upper surface of the roof structure 54 and the shield 10 engages the outer edge 60 of the gutter 50. Prior systems relying on brackets or nails essentially support the gutter 50 by means of a cantilever. The present arrangement supports the gutter by a direct connection to the roof in a structure which acts less like a cantilever and more like a cable in tension. The structure reinforces the gutter 50 and transfers the load from the gutter to the roof.

In the embodiment illustrated, for a typical gutter system, the gutter guard 10 has an overall width of about 6 inches. The inboard marginal area 18 is about 2 inches. The outboard marginal area 20 is about ½ inch and the vane portion 22 is about 3½ inches. In the embodiment illustrated, 14 (¼ inch) vanes 26 are formed in parallel rows. The slots 26 are formed in parallel rows which are separated by the vane width and are interrupted by the ⅛ inch vane supports 28 which are spaced on approximately ½ inch centers. The vane supports 28 in one row are offset from vane supports in adjacent rows by approximately half the distance between the slots. The vanes 26 extend away from the lower surface 78 of the stock material 12 forming slots 24 which are about at least as wide as the thickness of the gutter shield stock material when properly installed. The vane inlets 31 face the roof structure 66 for receiving rainwater therein. The outlets 33 of the vanes 26 are below the vanes immediately above the gutter trough 64.

While there have been described what at present are considered to be the preferred embodiments of the present invention, it will be readily apparent to those skilled in the art that various changes may be made therein without departing from the invention and it is intended in the claims to cover such changes and modifications as fall within the true spirit and scope of the invention.

What is claimed is:

1. A gutter shield adapted to be secured to an outboard edge of an open top of a gutter adjacent a roof edge of a structure for allowing rainwater to enter the gutter through the open top an for restricting the accumulation of seed sized particles and leaf fragments in the gutter, said gutter shield comprising:

an elongated member formed with top and bottom surfaces having inboard and outboard marginal areas and an intermediate slotted vane portion, and first and second parallel lateral edges adjacent the inboard and outboard marginal areas, said slotted vane portion being formed with a plurality of relatively narrow elongated linear slots arranged in a plurality of rows running parallel to the marginal edges, said slots being opened in a direction facing the inboard edge for allowing rain water therethrough but being sufficiently small to prevent the passage of relatively small seed sized particles and leaf fragments therethrough, said slotted vane portion including a plurality of vanes running parallel to the marginal edges, each of said vanes being adjacent a corresponding one of the rows of slots, said vanes having a free edge and extending from the slotted vane portion toward the outboard marginal area away from the bottom side for directing the rain water into the gutter, and a plurality of vane supports interconnecting adjacent vanes between the slots, said inboard marginal area adapted to overly the roof edge for attachment thereto and the outboard marginal area adapted to overly the outboard gutter edge for attachment thereto and the vane portion overlying the open top of the gutter at a shallow angle extended downwardly away from the structure when attached between the roof and the gutter.

2. The gutter shield of claim 1, wherein inboard and outboard marginal areas are parallel and the inboard marginal area is adapted to extend over a portion of the roof corresponding to about ⅓ of the overall width of the elongated member.

3. The gutter shield according to claim 1, wherein the vane supports further comprise domed portions interconnecting adjacent vanes and extending away from the elongated member in the same direction as the vanes.

4. The gutter shield of claim 1, wherein the outboard marginal area is formed with a plurality of apertures for facilitating attachment to the gutter by means of fasteners.

5. The gutter shield of claim 1, wherein the gutter is disposed along a direction coplanar with the roof structure and the vanes have inlets facing the roof structure for receiving and directing water into the gutter.

6. The gutter shield of claim 1, wherein the vanes extend at an angle from the top surface away from the bottom surface, forming inlets and outlets for the slots, said angled vanes adapted for directing rain water from the inlets to the outlets.

7. A gutter shield adapted to be secured to an outboard edge of an open top of a gutter adjacent a roof edge of a structure for supporting the gutter and for allowing rainwater to enter the gutter through the open top and for restricting the accumulation of relatively small seed sized particles and leaf fragments in the gutter, said gutter shield comprising:

an elongated member formed with first and second surfaces having inboard and outboard marginal areas and an intermediate slotted vane portion, and first and second parallel lateral edges adjacent the inboard and outboard marginal areas, said slotted vane portion being formed with a plurality of relatively small slots arranged in a plurality of rows running parallel to the marginal edges said slots being sufficiently small to prevent passage of seed sized particles and leaf fragments and sufficiently open to allow rain water to pass therethrough, said vane portion including a plurality of vanes running parallel to the marginal edges, each of said vanes being adjacent a corresponding one of the rows of slots, said vanes extending from the slotted vane portion away from the second surface, and a plurality of dome shaped vane supports interconnecting adjacent vanes between the slots, said inboard marginal area adapted to overly the roof edge for attachment thereto and the outboard marginal area adapted to overly the outboard gutter edge for attachment thereto and the vane portion overlying the open top of the gutter when attached between the roof and the gutter.

8. A gutter shield adapted to be secured to an outboard edge of an open top of a gutter adjacent a roof edge of a structure for allowing rainwater to enter the gutter through the open top and for restricting the accumulation of debris in the gutter, said gutter shield comprising:

an elongated member formed with top and bottom surfaces having inboard and outboard marginal areas and an intermediate slotted vane portion, and first and second parallel lateral edges adjacent the inboard and outboard marginal areas, said slotted vane portion being with a plurality of relatively narrow elongated linear slots arranged in a plurality of rows running parallel to the marginal edges, said slots being opened in a direction facing the outboard edge for allowing rain water therethrough but being sufficiently small to prevent the passage of seed sized particles and leaf fragments therethrough, said vane slotted portion including a plurality of vanes running parallel to the marginal edges, each of said vanes being adjacent a corresponding one of the rows of slots, said vanes having a free edge and extending from the slotted vane portion toward the inboard marginal areas and away from the bottom side for directing the rain water into the gutter, and a plurality of vane supports in the form of domed supports laterally interconnecting adjacent vanes between the slots and extending away from the elongated member in the same direction as the vanes, said inboard marginal area adapted to overly the roof edge for attachment thereto and the outboard marginal area adapted to overly the outboard gutter edge for attachment thereto and the vane portion overlying the open top of the gutter at a shallow angle away from the structure when attached between the roof and the gutter.

* * * * *